US008433217B2

(12) United States Patent
Yamakawa et al.

(10) Patent No.: US 8,433,217 B2
(45) Date of Patent: Apr. 30, 2013

(54) PHOTORECEPTOR, COOLING MECHANISM FOR PHOTORECEPTOR, AND IMAGE FORMING APPARATUS PROVIDED WITH THE SAME

(75) Inventors: Tomohiko Yamakawa, Osaka (JP); Syouji Kouda, Osaka (JP); Hidehisa Konishi, Osaka (JP); Mitsuhiro Goda, Osaka (JP); Susumu Hanano, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 109 days.

(21) Appl. No.: 13/071,619

(22) Filed: Mar. 25, 2011

(65) Prior Publication Data

US 2011/0243596 A1 Oct. 6, 2011

(30) Foreign Application Priority Data

Mar. 31, 2010 (JP) ..... 2010-081162

(51) Int. Cl.
*G03G 15/00* (2006.01)

(52) U.S. Cl.
USPC ..... 399/96; 492/46

(58) Field of Classification Search ..... 399/92, 399/96, 116, 117, 159; 492/18, 46; 464/17; 165/89
See application file for complete search history.

(56) References Cited

U.S. PATENT DOCUMENTS

| | | | | |
|---|---|---|---|---|
| 4,607,936 | A * | 8/1986 | Miyakawa et al. | 399/92 |
| 5,788,382 | A * | 8/1998 | Egbert et al. | 400/118.3 |
| 6,615,011 | B2 * | 9/2003 | Yoshikawa | 399/250 |
| 7,024,130 | B2 * | 4/2006 | Serizawa et al. | 399/96 |

FOREIGN PATENT DOCUMENTS

| | | | |
|---|---|---|---|
| JP | 55-052080 | A | 9/1978 |
| JP | 57167044 | A * | 10/1982 |
| JP | 58194062 | A * | 11/1983 |
| JP | S59-66262 | A | 4/1984 |
| JP | 59206857 | A * | 11/1984 |
| JP | 62031878 | A * | 2/1987 |
| JP | 05-289590 | | 11/1993 |
| JP | 07-271240 | | 10/1995 |
| JP | 2002278363 | A * | 9/2002 |
| JP | 2003195686 | A * | 7/2003 |
| JP | 2005-090574 | A | 7/2005 |
| JP | 2008-165139 | A | 7/2008 |

OTHER PUBLICATIONS

Notice of Reasons for Rejection issued to Japanese Application No. 2010-081162, mailed Mar. 28, 2012.
Notice of Reasons for Rejection issued to JP Application No. 2010-081162, mailed Aug. 29, 2012.

* cited by examiner

*Primary Examiner* — Robert Beatty

(57) ABSTRACT

A cooling mechanism for a photoreceptor includes: a photoreceptor of cylindrical shape; a pair of flanges respectively attached to both ends in an axial direction of the photoreceptor; a rotational shaft that is inserted into a shaft center of the photoreceptor; a holder that is disposed to face a first flange and rotatably supports the rotational shaft; and a main body frame that supports the holder. In such a cooling mechanism for a photoreceptor, an air duct is configured by the through hole formed in the flange and the concave portion formed on the holder, and discharges air flow generated inside the photoreceptor to the outside thereof.

7 Claims, 5 Drawing Sheets

PHOTORECEPTOR, COOLING MECHANISM FOR PHOTORECEPTOR, AND IMAGE FORMING APPARATUS PROVIDED WITH THE SAME

This application is based on and claims the benefit of priority from Japanese Patent Application No. 2010-081162, filed on 31 Mar. 2010, the content of which is incorporated herein by reference.

BACKGROUND OF THE INVENTION

1. Field of the Invention

The present invention relates to a photoreceptor such as a photoreceptor drum, a cooling mechanism for the photoreceptor, and an image forming apparatus provided with the cooling mechanism for the photoreceptor.

2. Related Art

In an image forming apparatus such as a copy machine and a printer, a photoreceptor such as a photoreceptor drum of which the surface is uniformly charged by a charging device is exposed and scanned by an optical scanning device, and an electrostatic latent image corresponding to image information is formed on the surface of the photoreceptor. Thereafter, the electrostatic latent image formed on the surface of the photoreceptor is developed by a developing device using a toner as a developer, and is visualized as a toner image. The toner image is transferred onto paper by a transfer device, and then heated, pressurized and fused onto the paper by a fusing device. The paper onto which the toner image is fused is ejected to the outside of the apparatus. The sequence of image forming operations is thus completed.

In an image forming apparatus, for example, a flange is attached to each of both ends in an axial direction of a cylindrical photoreceptor drum. In addition, the photoreceptor drum is rotatably supported by a main body frame via a rotational shaft inserted into the axial center thereof and shaft bearings that support the rotational shaft. The photoreceptor drum is rotationally driven at a predetermined speed by a driving force from a drive source.

In a case where the photoreceptor drum that supports a toner image on a surface thereof is heated as described above and the temperature of the photoreceptor drum rises above the melting point of the toner, problems arise such as the toner fusing onto the surface of the photoreceptor drum. To address the problem, cooling of the photoreceptor is performed by introducing air flow inside of the photoreceptor drum.

However, in an image forming apparatus configured such that a rotational shaft that is inserted into the axial center of the photoreceptor drum is rotatably supported by a main body frame via shaft bearings supported by a holder, the holders supporting the shaft bearings block a through hole of one of flanges of the photoreceptor and prevents efficient discharge of air flow circulating inside the photoreceptor to the outside thereof. As a result, there has been a problem in that the cooling performance of the photoreceptor declines.

SUMMARY OF THE INVENTION

The present invention has an object of providing: a photoreceptor with high cooling performance; a cooling mechanism for the photoreceptor that can efficiently cool down the photoreceptor; and an image forming apparatus provided with the cooling mechanism for the photoreceptor.

In order to achieve the abovementioned object, an aspect of the present invention is a photoreceptor including: flanges attached to both ends in an axis direction thereof, respectively; a rotational shaft that is inserted into a shaft center thereof is rotatably supported by a main body frame of an image forming apparatus via a shaft bearing supported by a holder; and an air duct including a through hole formed in the flange and a concave portion formed on the holder disposed to face the flange, and allowing discharge of air flow generated inside the photoreceptor to the outside thereof.

Another aspect of the present invention is a cooling mechanism for a photoreceptor including: a photoreceptor of cylindrical shape; a pair of flanges respectively attached to both ends in an axial direction of the photoreceptor; a rotational shaft that is inserted into a shaft center of the photoreceptor; a holder that is disposed to face a first flange of the pair of flanges and rotatably supports the rotational shaft via a shaft bearing; and a main body frame that supports the holder, wherein: the pair of flanges has a through hole formed so as to penetrate in the axial direction of the photoreceptor; the holder has a concave portion that is formed at an outer periphery of the holder and extends in the axial direction; and an air duct is configured by the through hole and the concave portion, and discharges air flow generated inside the photoreceptor to the outside thereof.

In the present invention, the through hole formed in the flange attached to a first end in the axial direction of the photoreceptor and the concave portion formed on the holder disposed to face the flange compose the air duct. As a result, the holder does not block the through hole of the flange. This allows efficiently discharge of air flow generated inside the photoreceptor to the outside thereof through the air duct and the photoreceptor is efficiently cooled down by the air flow.

DETAILED DESCRIPTION OF THE INVENTION

An embodiment of the present invention is explained hereinafter with reference to the attached drawings.

Figure 1:
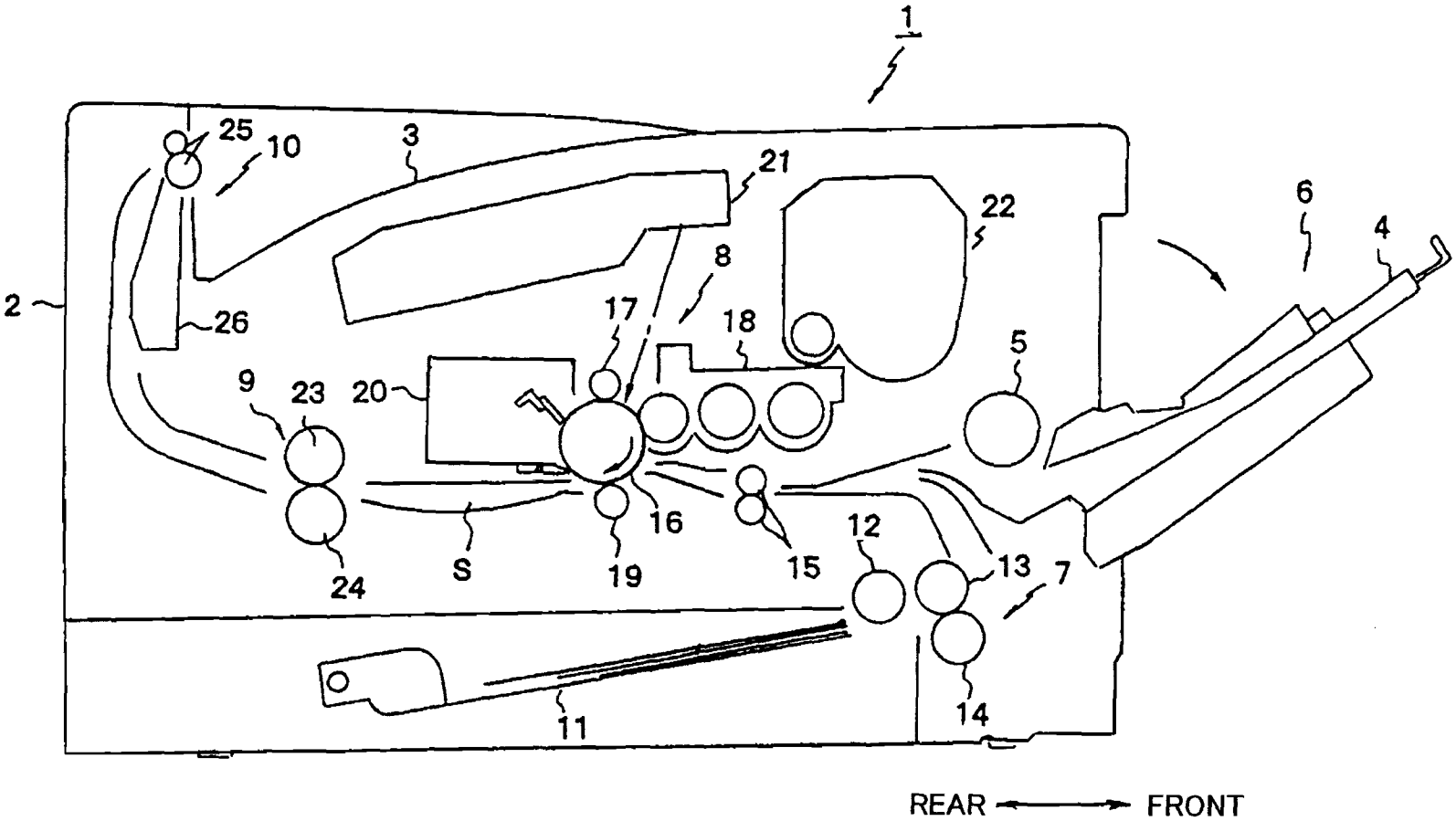
FIG. 1 is a cross-sectional side view of an image forming apparatus (laser printer) according to the present invention.

FIG. 1 is a cross-sectional view of a laser printer as an embodiment of an image forming apparatus according to the present invention. As shown in FIG. 1, in the laser printer 1, a tilted and concave catch tray 3 is provided in a central portion of a top face of a rectangular box-shaped printer main body (housing) 2. In addition, a manual feed tray 4 that is openable and closable is provided in an upper portion of a front face (right side of FIG. 1) of the printer main body 2. The manual feed tray 4 and a paper feed roller 5 for manual feeding that is rotatably provided inside the printer main body 2 compose a manual feed portion 6.

The laser printer 1 forms an image on paper as a recording material based on image data transmitted from a terminal (not illustrated) or the like, while feeding the paper along a paper feed path S provided inside the printer main body 2. The paper feed path S extends in a substantially L-shape in a side view, from the manual feed portion 6 to the catch tray 3.

The laser printer 1 includes: a cassette feeding portion 7 provided in a lower portion of the printer main body 2; an image forming portion 8 provided in a substantially central portion inside the printer main body 2, above the cassette feeding portion 7; a fusing device 9 disposed behind the image forming portion 8; and a concave paper ejection portion 10 provided on an upper face of the printer main body 2, above the fusing device 9.

The cassette paper feeding portion 7 is provided with: a paper feeding cassette 11 in a rectangular tray shape with an open upper face, housing a plurality of stacked sheets of paper thereinside; a pick-up roller 12 for picking up the paper in the paper feeding cassette 11 sheet by sheet; a feed roller 13 and a retard roller 14 for separating the paper thus picked up and feeding the paper to a paper feed path S sheet by sheet. In addition, a resist roller pair 15 is provided in the paper feed path S and feeds the paper to the image forming portion 8 at a predetermined timing after having made the paper that has been fed to temporarily standby.

The image forming portion 8 forms an image corresponding to image data on the paper that has been fed sheet by sheet from the manual feed portion 6 or the paper feeding portion 7. The image forming portion 8 includes: a photoreceptor drum 16 as an image supporting body; a charging device 17; a developing device 18 as the developing means; an image transfer roller 19 as an image transfer means; a cleaning device 20; an optical scanning device (LSU: laser scanner unit) 21; and a toner hopper 22 that houses a toner for supply.

The photoreceptor drum 16 is rotatably disposed in a substantially central portion of the inside the printer main body 2. The charging device 17, the developing device 18, the transfer roller 19 and the cleaning device 20 are disposed at a periphery of the photoreceptor drum 16. The optical scanning device (LSU) 21 and the toner hopper 22 are disposed above the photoreceptor drum 16, the charging device 17, the developing device 18, the transfer roller 19 and the cleaning device 20.

The fusing device 9 is designed to fuse a toner image transferred to the paper by the image forming portion 8 onto the paper. The fusing device 9 is provided with a fuser roller 23 and a pressure roller 24 that rotate in pressurized contact with each other. The fuser roller 23 includes a heating means such as a heater. The pressure roller 24 is pressurized with a predetermined pressure against the fuser roller 23 by a biasing means such as a spring. A fusing nip is formed between the fuser roller 23 and the pressure roller 24.

The paper ejection portion 10 ejects the paper, on which the toner image is fused by the fusing device 9, to the outside of the printer main body 2. The paper ejection portion 10 is provided with: a paper ejection roller pair 25 disposed one above the other in an end of the paper feed path S; a plurality of feed guide ribs 26 in a vertical rib shape that guides the paper, which is fed from the fusing device 9 along the paper feed path S, toward the paper ejection roller pair 25; and the catch tray 3 that accepts the paper ejected to the outside of the printer main body 2.

Image forming operations by the laser printer 1 thus configured are explained hereinafter.

When a terminal such as a personal computer, for example, transmits a print start signal to the laser printer 1, in the image forming portion 8, the photoreceptor drum 16 is rotationally driven at a predetermined processing speed in the direction of the arrow shown in FIG. 1 (clockwise direction) by a drive means (not illustrated). The surface of the photoreceptor drum 16 is then uniformly charged at a predetermined potential by the charging device 17. Thereafter, the optical scanning device 21 outputs laser light based on the image data transmitted from the terminal to irradiate the surface of the photoreceptor drum 16, and an electrostatic latent image corresponding to the image data is thus formed on the surface of the photoreceptor drum 16. The electrostatic latent image formed on the surface of the photoreceptor drum 16 is developed by the developing device 18 using a toner as a developer, and is thereby visualized as a toner image.

In a case of cassette feeding, the paper housed inside the paper feeding cassette 11 of the cassette feeding portion 7 is picked up by the pick-up roller 12 sheet by sheet from the topmost sheet. Then, the paper thus picked up by the pick-up roller 12 is separated by the feed roller 13 and the retard roller 14 sheet by sheet and fed to the resist roller pair 15. In the resist roller pair 15, the paper stands by temporarily and is fed to the image forming portion 8 at a predetermined timing of synchronizing with the toner image developed on the surface of the photoreceptor drum 16.

In the image forming portion 8, the paper fed to the transfer nip between the photoreceptor drum 16 and the image transfer roller 19 is fed in a state of being pressed against the photoreceptor drum 16 by the transfer roller 19. The toner image developed on the surface of the photoreceptor drum 16 is thus transferred to a surface (transfer surface) of the paper. The paper onto which the toner image has been transferred is then fed to the fusing device 9. The paper fed to the fusing device 9 is heated and pressurized in the fusing device 9, in a state of being sandwiched by a fusing nip formed between the fuser roller 23 and the pressure roller 24. The toner image is thus fused onto the paper. Residual toner, which remains on the surface of the photoreceptor drum 16 after the transfer of the toner image to the paper, is removed by the cleaning device 20, and the photoreceptor drum 16 of which the surface has been cleaned is ready for the next image forming operation.

The paper onto which the toner image is fused by the fusing device 9 is then fed to an upper side of the paper feed path S toward the paper ejection portion 10. Thereafter, the paper is guided along the feed guide ribs 26 toward the paper ejection roller pair 25, and ejected to the outside of the printer main body 2 in a state of being sandwiched between the paper ejection roller pair 25. The paper ejected to the outside of the printer main body 2 is placed on the catch tray 3 provided in the upper portion of the apparatus main body 2, thereby ending the sequence of image forming operations.

In a case in which a user feeds the paper by manual feeding, the paper placed on the manual feed tray 4 of the manual feed portion 6 is fed to the resist roller pair 15 by the paper feed roller 5 for manual feeding. Thereafter, through the same processes as above, an image is formed on the paper, and the paper on which the image is formed is placed on the catch tray 3 outside of the apparatus main body 2.

Figure 2:
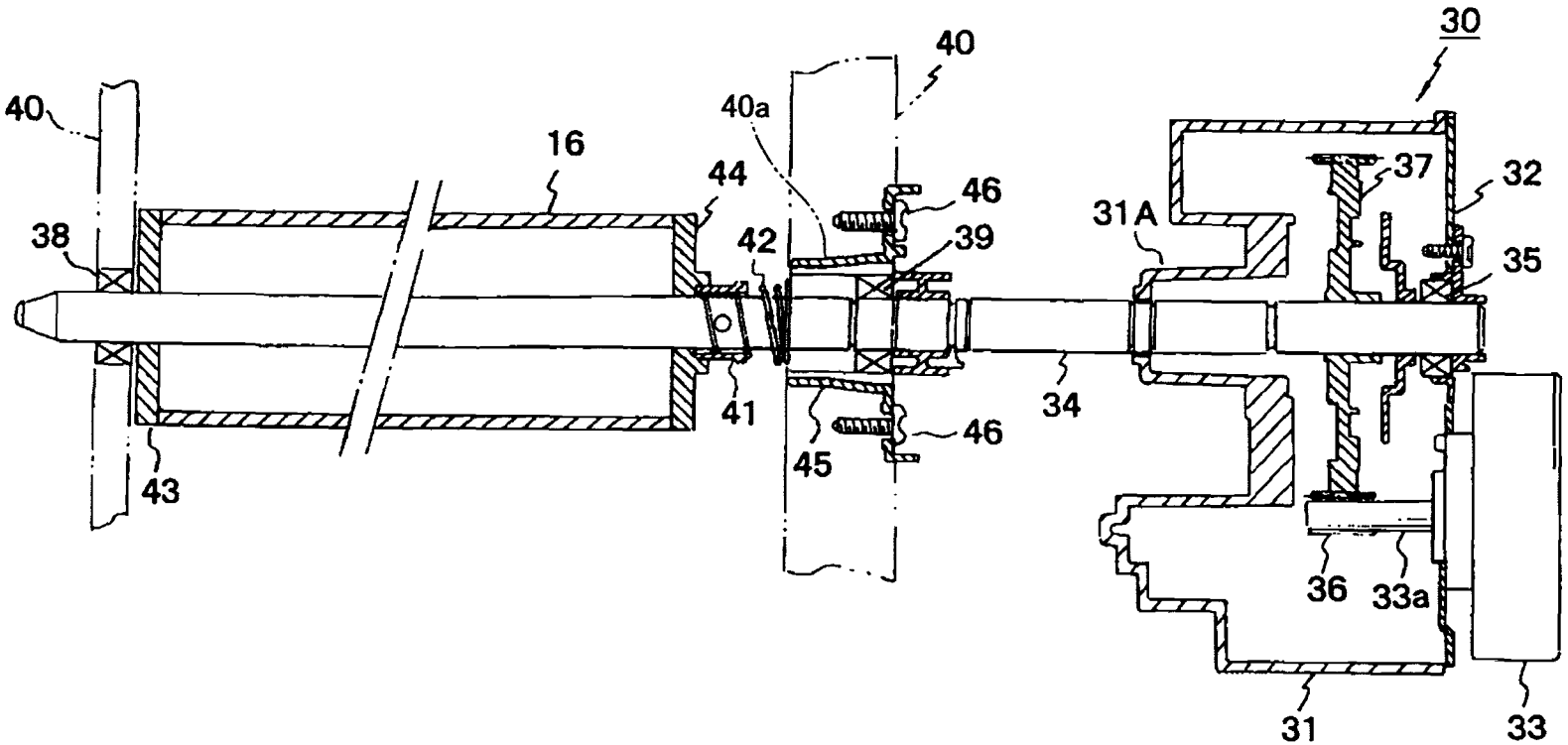
FIG. 2 is a cross-sectional side view showing a drive system of a photoreceptor drum of the image forming apparatus according to the present invention.
Figure 3:
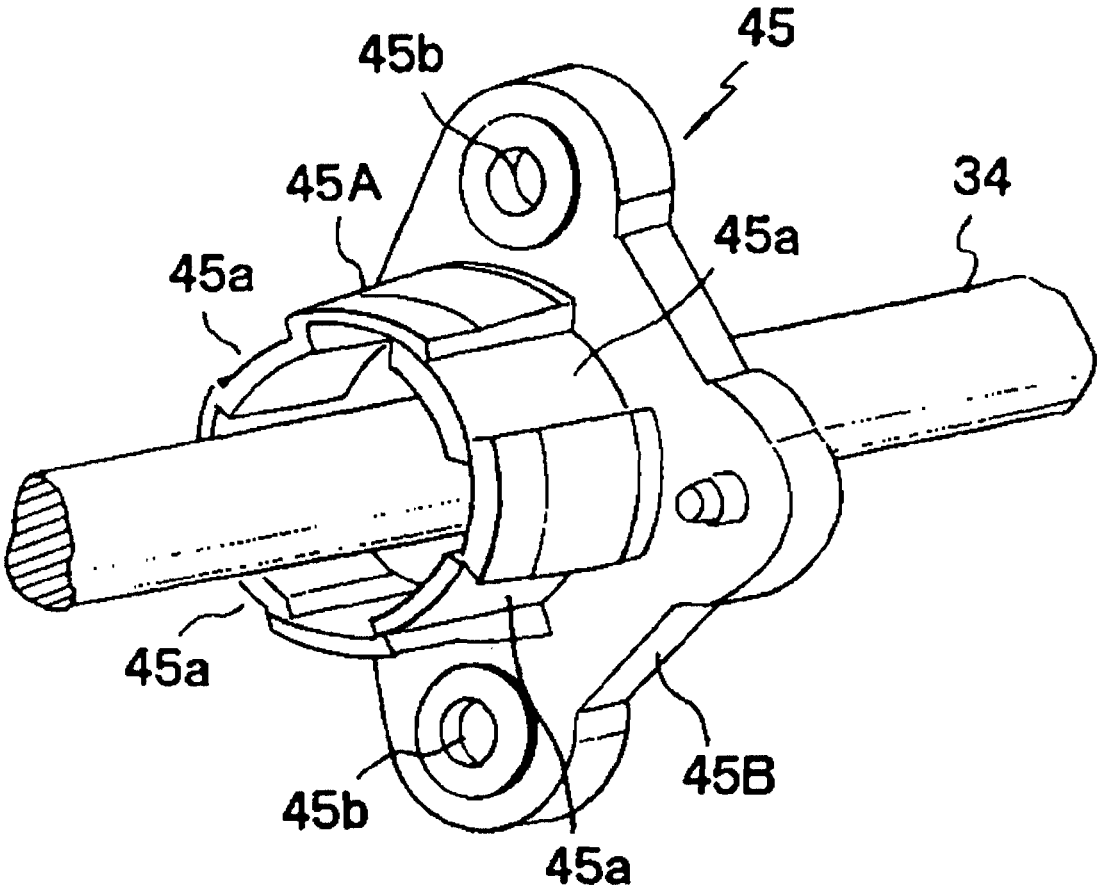
FIG. 3 is a perspective view of a holder.
Figure 4:
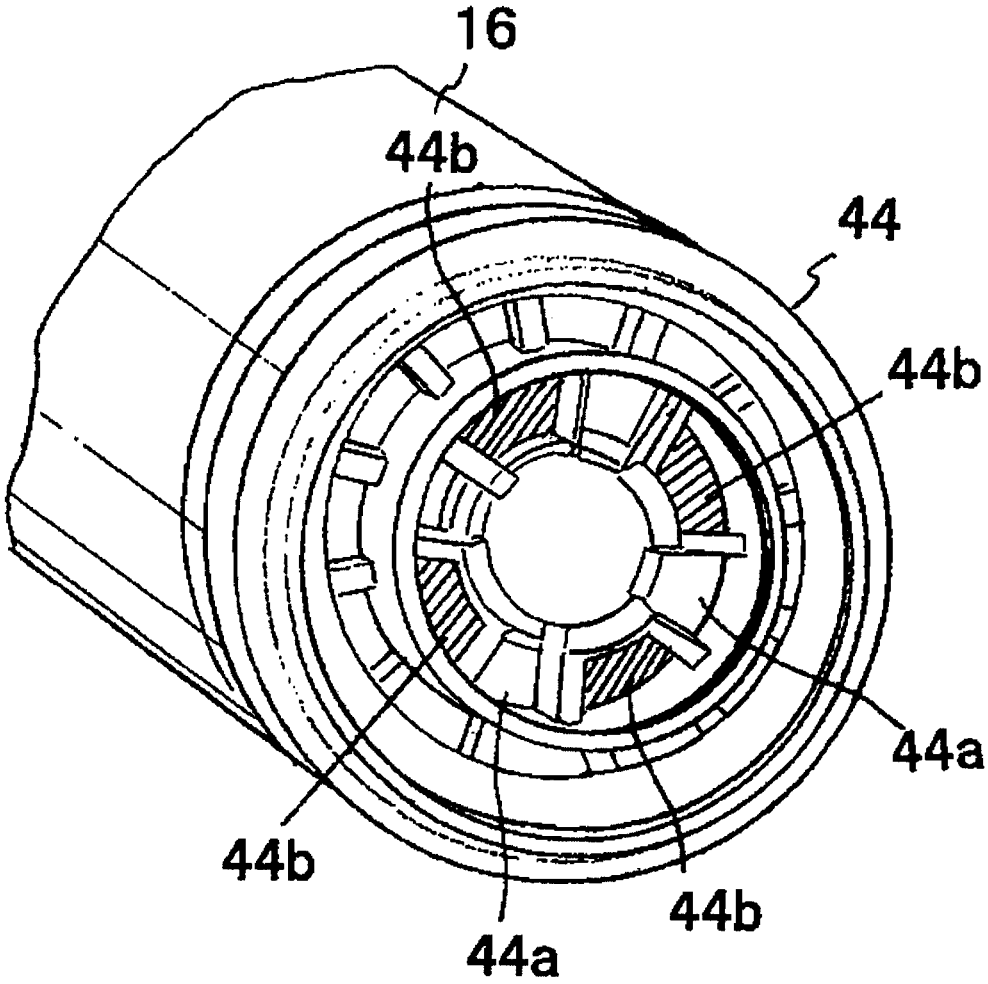
FIG. 4 is a partial perspective view of a photoreceptor drum.
Figure 5:
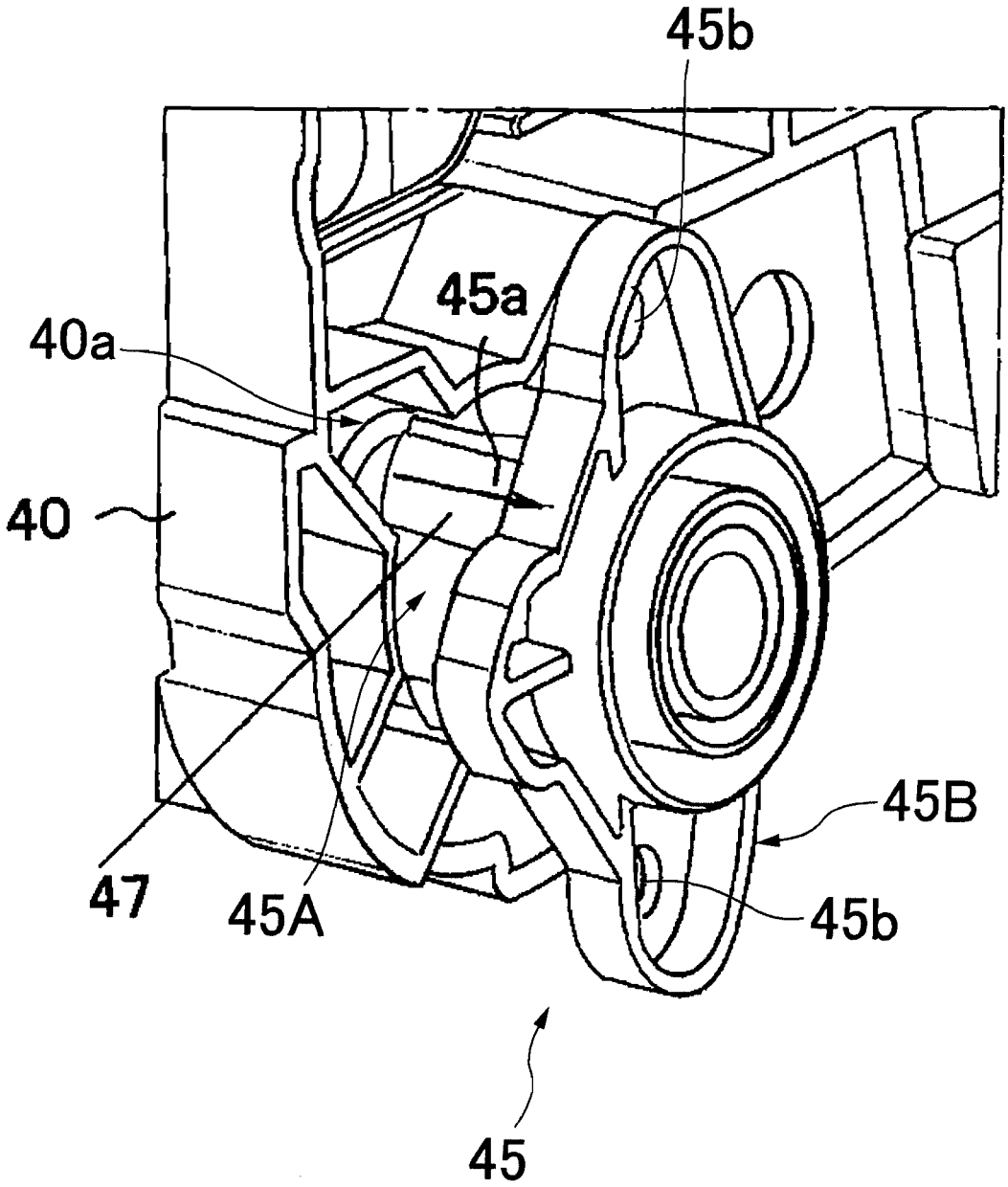
FIG. 5 is a partial perspective view of a cooling mechanism of the photoreceptor drum according to the present invention.

The photoreceptor drum 16 is rotationally driven by the rotational drive unit 30 shown in FIG. 2 at a predetermined speed (process speed). A drive system and a cooling mechanism of the photoreceptor drum 16 are explained hereinafter with reference to FIGS. 2 to 5. FIG. 2 is a cross-sectional side view showing a drive system of the photoreceptor drum. FIG. 3 is a perspective view of the holder. FIG. 4 is a partial perspective view of the photoreceptor drum. FIG. 5 is a partial perspective view of the cooling mechanism of the photoreceptor drum.

As shown in FIG. 2, the rotational drive unit 30 is provided with a box-shaped housing 31 with an open end face (right end face in FIG. 2), which is covered by a plate 32. A motor 33 and a shaft bearing 35 are attached to the plate 32. The motor 33 is a drive source that generates a rotational drive force. The shaft bearing 35 rotatably supports the drum shaft 34, which is a rotational shaft, at a first end thereof in an axial direction on a side inserted into the housing 31 (right end in FIG. 2).

An output shaft (motor shaft) 33*a* of the motor 33 projects horizontally inside the housing 31. A gear 37 of a large diameter, which is fixed to a portion of the drum shaft 34 inserted into the housing 31, engages with a pinion 36 of a small diameter formed at an end of the motor shaft 33*a*.

A first end portion (right end portion in FIG. 2) of the drum shaft 34 that penetrates an axial center of the photoreceptor drum 16 is inserted horizontally into the housing 31 by penetrating a boss portion 31A of the housing 31. The first end portion of the drum shaft 34 is rotatably supported by the plate 32 via the shaft bearing 35 attached to the plate 32.

In addition, two portions of the drum shaft 34 that are outside the housing 31 (left end portion and central portion) are rotatably supported by the main body frame 40 via shaft bearings 38, 39. As a result, three points in the axial direction of the drum shaft 34 are rotatably supported by the shaft bearings 35, 38, 39. In the vicinity of the shaft bearing 39 of the drum shaft 34, a coupling 41 is inserted so as to be slidable in the axial direction with respect to the drum shaft 34. The coupling 41 is supported by the drum shaft 34 so as not to be rotatable in a circumferential direction (i.e. so as to rotate integrally with the drum shaft 34) and is biased toward the photoreceptor drum 16 by a spring 42.

Flanges 43, 44 are attached to both ends in the axial direction of the photoreceptor drum 16, respectively. As shown in FIG. 4, on a first flange 44, eight engaging grooves 44*a*, with which the coupling 41 engages, are formed in a circumferential direction. Through holes 44*b* (marked by diagonal lines in FIG. 4), which allow the inside and outside of the cylindrical shaped photoreceptor drum 16 to be in communication, are formed in alternating four of the eight engaging grooves 44*a*. Although not illustrated, a plurality of similar through holes is formed also in a second flange 43. In addition, a blade that functions as a fan is formed on an inner face of the flanges 43, 44.

Incidentally, the shaft bearing 39 that rotatably supports the drum shaft 34 is supported by the holder 45. As shown in FIG. 3, the holder 45 is provided with a cylindrical engaging portion 45A and a flange portion 45B integrally formed in an end portion of the engaging portion 45A. At four positions on an outer periphery of the engaging portion 45A, a concave portion 45*a* that extends in an axial direction of the drum shaft 34 is formed. Furthermore, a circular hole 45*b* is formed above and below the flange portion 45B of the holder 45.

As shown in FIG. 5, the holder 45 is positioned by the engaging portion 45A thereof being inserted into the circular hole 40*a* of the main body frame 40. Thereafter, the holder 45 is attached to the main body frame 40 by means of screws 46 (see FIG. 2) that are inserted into two circular holes 45*b* formed in the flange portion 45B. Here, the four concave portions 45*a* formed on an outer periphery of the engaging portion 45A and the four through holes 44*b* formed on the first flange 44 of the photoreceptor drum 16 facing the holder 45 (see FIG. 4) configure an air duct 47, respectively.

Then, when the motor 33 attached to the plate 32 of the rotational driving unit 30, as shown in FIG. 2, is started, rotation of the output shaft (motor shaft) 33*a* of the motor 33 is reduced by the pinion 36 and the gear 37, and transferred to the drum shaft 34, thereby rotationally driving the drum shaft 34 at a predetermined speed. Thereafter, rotation of the drum shaft 34 is transferred to the photoreceptor drum 16 via the coupling 41 and the flange 44 with the engaging grooves 44*a* that engage with the coupling 41, thereby rotationally driving the photoreceptor drum 16 along with the drum shaft 34 at a predetermined speed (process speed) for image formation.

When the photoreceptor drum 16 thus rotates, air is introduced into the photoreceptor drum 16 via the through hole (not illustrated) of the second flange 43, by a fan action of the blade provided on the inner faces of the flanges 43, 44 that rotate along with the photoreceptor drum 16. Thereafter, the air introduced into the photoreceptor drum 16 flows inside the photoreceptor drum 16 in the axial direction (right direction in FIG. 2) toward the first flange 44. In this case, the holder 45 does not block the through hole 44*b* of the flange 44, thereby allowing efficient discharge of the air to the outside of the photoreceptor drum 16 via the air duct 47 configured by the through hole 44*b* of the flange 44 and the engaging portion 45A of the holder 45. As a result, the photoreceptor drum 16 is efficiently cooled by air flow in the axial direction generated thereinside. This realizes a stable image forming operation without the problem of toner fusing onto the surface of the photoreceptor drum 16.

It should be noted that, although the above description shows an embodiment of the present invention applied to a laser printer and to a rotational drive unit provided therein, the present invention can be equally applied to other image forming apparatuses such as a printer, a copying machine and the like, and a rotational drive unit provided therein.

What is claimed is:

1. A photoreceptor, comprising:

flanges attached to both ends of the photoreceptor in an axis direction thereof, respectively;

a rotational shaft that is inserted into a shaft center of the photoreceptor rotatably supported by a main body frame of an image forming apparatus via a shaft bearing supported by a holder disposed to face one of the flanges; and a through hole formed in each of the flanges, wherein the holder includes:

a cylindrical engaging portion; and a concave portion penetrating an outer periphery of the cylindrical engaging portion in the axial direction and being partitioned in a circumferential direction of the cylindrical engaging portion, wherein the through hole formed in each of the flanges and the concave portion provide an air passage, such that an air flow generated inside the photoreceptor is discharged outside via the air passage.

2. A cooling mechanism for a photoreceptor comprising:

a photoreceptor;

a pair of flanges respectively attached to both ends of the photoreceptor in an axial direction thereof;

a rotational shaft that is inserted into a shaft center of the photoreceptor;

a holder that is disposed to face one of the pair of flanges and rotatably supports the rotational shaft via a shaft bearing; and a main body frame that supports the holder, wherein the pair of flanges has a through hole formed so as to penetrate in the axial direction, wherein the holder has a cylindrical engaging portion and a concave portion that is formed at an outer periphery of the cylindrical engaging portion, wherein the concave portion penetrates the cylindrical engaging portion in the axial direction and is partitioned in a circumferential direction of the cylindrical engaging portion, and wherein the through hole and the concave portion provide an air passage, such that an air flow generated inside the photoreceptor is discharged outside via the air passage.

3. The cooling mechanism according to claim 2, further comprising a blade disposed at an inner face of the pair of flanges.

4. An image forming apparatus comprising the photoreceptor according to claim 1.

5. An image forming apparatus comprising the cooling mechanism for a photoreceptor according to claim 2.

6. A holder which is structurally independent of a photoreceptor, the holder rotatably supporting a rotational shaft inserted in an axial center of the photoreceptor with respect to a main body frame, the photoreceptor having flanges attached to both ends thereof in an axial direction of the photoreceptor, comprising:

a cylindrical engaging portion, wherein the cylindrical engaging portion includes a concave portion formed at an outer periphery of the cylindrical engaging portion, the concave portion penetrating the cylindrical engaging portion in the axial direction and being partitioned in a circumferential direction of the cylindrical engaging portion, and wherein the concave portion provides a through air passage in the axial direction.

7. A holder which is structurally independent of a photoreceptor, the holder rotatably supporting a rotational shaft inserted in an axial center of the photoreceptor with respect to a main body frame via a shaft bearing, the photoreceptor having flanges attached to both ends thereof in an axial direction of the photoreceptor, comprising:

a cylindrical engaging portion, wherein the cylindrical engaging portion includes a concave portion formed at an outer periphery of the cylindrical engaging portion, the concave portion penetrating the cylindrical engaging portion in the axial direction and being partitioned in a circumferential direction of the cylindrical engaging portion, and wherein the concave portion provides a through air passage in the axial direction.

* * * * *